US009635958B2

(12) United States Patent
Neelagantan et al.

(10) Patent No.: US 9,635,958 B2
(45) Date of Patent: May 2, 2017

(54) WELDLESS SHELF ASSEMBLIES FOR MERCHANDISING DISPLAY CASES

(71) Applicant: Heatcraft Refrigeration Products LLC, Richardson, TX (US)

(72) Inventors: Chera Selvan Neelagantan, Columbus, GA (US); Satish Kumar Jatashanker Singh, Columbus, GA (US); Randall Booker, Columbus, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 0 days.

(21) Appl. No.: 14/744,043

(22) Filed: Jun. 19, 2015

(65) Prior Publication Data

US 2016/0367047 A1 Dec. 22, 2016

(51) Int. Cl.

| | |
|---|---|
| ***A47F 3/14*** | (2006.01) |
| ***A47F 3/00*** | (2006.01) |
| ***A47F 3/04*** | (2006.01) |
| ***A47F 3/06*** | (2006.01) |

(52) U.S. Cl.

CPC ..... *A47F 3/14* (2013.01); *A47F 3/005* (2013.01); *A47F 3/04* (2013.01); *A47F 3/0439* (2013.01); *A47F 3/06* (2013.01)

(58) Field of Classification Search

CPC ..... A47B 96/02; A47B 96/021; A47B 96/024; A47B 96/027; A47B 96/028; A47B 57/46; A47B 96/06; A47B 96/061; A47F 3/001; A47F 3/06; A47F 3/0426; A47F 3/0482; A47F 3/0486; A47F 5/0043

See application file for complete search history.

(56) References Cited

U.S. PATENT DOCUMENTS

| | | | | |
|---|---|---|---|---|
| 2,790,559 A | | 4/1957 | Stephenson et al. | |
| 2,845,187 A | * | 7/1958 | Bianchi | 108/147.17 |
| 3,082,880 A | | 3/1963 | Mapson | |
| 3,088,424 A | | 5/1963 | Knuth | |
| 3,130,693 A | | 4/1964 | Shell | |
| 3,469,543 A | | 9/1969 | Everett | |
| 3,511,193 A | | 5/1970 | Schild | |
| 3,556,306 A | | 1/1971 | Shell | |
| 3,637,087 A | * | 1/1972 | Denny | 211/192 |
| 4,139,247 A | | 2/1979 | Karashima | |
| 4,344,367 A | | 8/1982 | Merl | |
| 4,607,576 A | * | 8/1986 | Kranjec | 108/110 |
| 4,996,929 A | * | 3/1991 | Saal | 108/107 |
| 5,022,541 A | | 6/1991 | White | |
| 5,205,421 A | | 4/1993 | Bustos | |
| 5,452,812 A | | 9/1995 | Niequist et al. | |
| 5,577,623 A | * | 11/1996 | Bustos | A47B 57/00 108/180 |
| 5,921,411 A | | 7/1999 | Merl | |

(Continued)

OTHER PUBLICATIONS

U.S. Appl No. 14/150,934, filed Jan. 9, 2014, Poly.

*Primary Examiner* — Andrew Roersma
(74) *Attorney, Agent, or Firm* — Hubbard Johnston, PLLC

(57) ABSTRACT

The present application provides a shelf assembly for a display case. The shelf assembly may include a shelf, a pair of shelf brackets with a shelf bracket pocket, and a support rail with a pair of tabs. The support rail extends between the pair of shelf brackets and the tabs of the support rail fit with the shelf bracket pockets of the pair of shelf brackets.

3 Claims, 9 Drawing Sheets

(56) References Cited

U.S. PATENT DOCUMENTS

| | | | | |
|---|---|---|---|---|
| 6,085,918 | A * | 7/2000 | Duff | A47B 57/48 108/109 |
| 6,189,707 | B1 | 2/2001 | Meyers et al. | |
| 6,520,353 | B2 | 2/2003 | Fulbright | |
| 6,585,393 | B1 * | 7/2003 | Brandes et al. | 362/235 |
| 6,892,993 | B2 * | 5/2005 | Palmer | 248/346.02 |
| 7,614,761 | B2 * | 11/2009 | Tanaka | 362/133 |
| 7,748,806 | B2 * | 7/2010 | Egan | 312/408 |
| 7,806,543 | B2 * | 10/2010 | Swofford et al. | 362/92 |
| 7,918,516 | B2 | 4/2011 | Decker et al. | |
| 8,899,162 | B2 | 12/2014 | Chikkakalbalu | |
| 2008/0037239 | A1 * | 2/2008 | Thomas et al. | 362/92 |
| 2008/0285260 | A1 * | 11/2008 | Sherman | 362/133 |
| 2009/0219720 | A1 * | 9/2009 | Reed | 362/308 |
| 2010/0271816 | A1 * | 10/2010 | Ozeki et al. | 362/217.05 |
| 2011/0042336 | A1 * | 2/2011 | Cheng et al. | 211/153 |
| 2011/0148267 | A1 * | 6/2011 | McDaniel et al. | 312/404 |
| 2011/0215693 | A1 * | 9/2011 | Golias et al. | 312/330.1 |
| 2012/0292277 | A1 * | 11/2012 | Chikkakalbalu | A47B 96/027 211/94.02 |
| 2014/0168953 | A1 * | 6/2014 | Madireddi et al. | 362/125 |

* cited by examiner

--Prior Art--

WELDLESS SHELF ASSEMBLIES FOR MERCHANDISING DISPLAY CASES

TECHNICAL FIELD

The present application and the resultant patent relate generally to a merchandising display case and more particularly relate to a refrigerated merchandising display case and the like with shelf assemblies having snap fit support rails instead of welded components for ease of installation and increased material options.

BACKGROUND OF THE INVENTION

The modern supermarket may have any number of refrigerated display cases to store and display different types of frozen and refrigerated products. Many different types of refrigerated display cases may be used, including multi-deck coolers, reach-in coolers, and the like. The refrigerated display cases are generally modular in nature such that any number of individual units may be combined to create a display case of any suitable length or size. Although the components of a refrigerated display case may be substantially modular in nature, the installation of such a refrigerated display case may involve a considerable amount of on-site labor to install the refrigeration components, the plumbing, the shelves, the lighting, the controls, and other types of components.

For example, conventional shelving assemblies may include a number of shelves with each shelf supported by pair of shelf brackets connected at opposite sides thereof. A number of connecting support rails may be secured between the shelf and the shelf brackets to reinforce the connections. The components of the shelf assemblies generally may be welded together so as to be permanently assembled. Specifically, a shelf assembly may be assembled by welding or spot welding on-site. Such welding may be time consuming and labor intensive.

There is thus a desire for an improved refrigerated display case and a method of installing the same. The installation and assembly of such an improved refrigerated display case or other type of merchandising display case and the like may be simplified through the use of fewer parts and overall lighter parts in a modular construction.

SUMMARY OF THE INVENTION

The present application and the resultant patent thus provide a shelf assembly for a display case. The shelf assembly may include a shelf, a pair of shelf brackets with a shelf bracket pocket, and a support rail with a pair of tabs. The support rail extends between the pair of shelf brackets and the tabs of the support rail fit with the shelf bracket pockets of the pair of shelf brackets.

The present application and the resultant patent further provide a method of assembling a shelf assembly for use in a display case. The method may include the steps of positioning a support rail between a pair of shelf brackets by inserting a first tab of the support rail into a first shelf bracket pocket of the first shelf bracket and a second tab of the support rail into a second shelf bracket pocket of the second shelf bracket, positioning a shelf on the pair of shelf brackets, and positioning the pair of shelf brackets within a pair of shelf standards The present application and the resultant patent further provide a refrigerated display case. The display case may include a display space and a number of shelf assemblies extending into the display space. The shelf assemblies may include a pair of shelf brackets with a shelf bracket pocket and a support rail with a pair of tabs. The support rail extends between the pair of shelf brackets and the tabs of the support rail fit with the shelf bracket pockets of the pair of shelf brackets.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
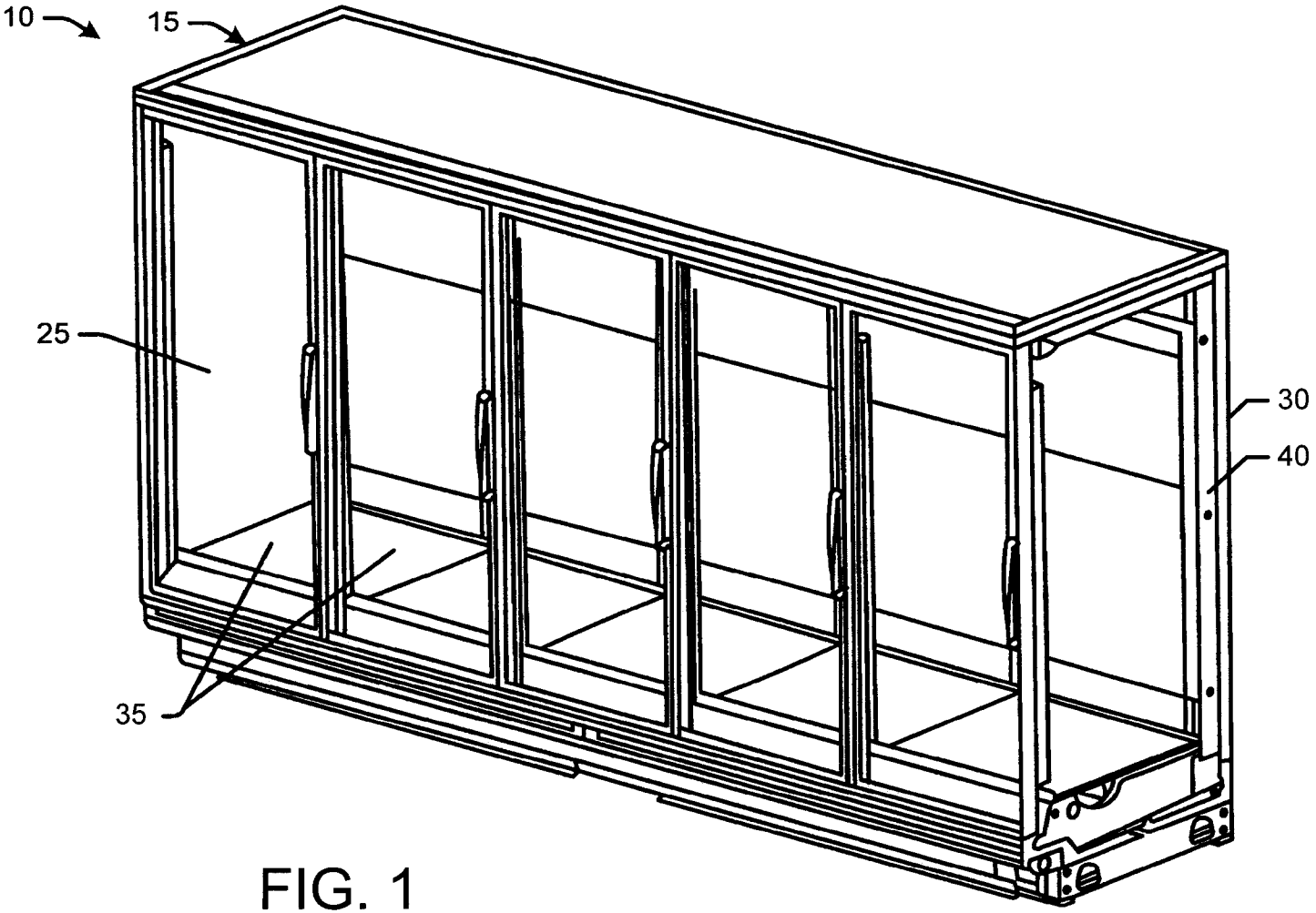
FIG. 1 is a perspective view of a portion of a known refrigerated display case in the form of a reach-in cooler.
Figure 2:
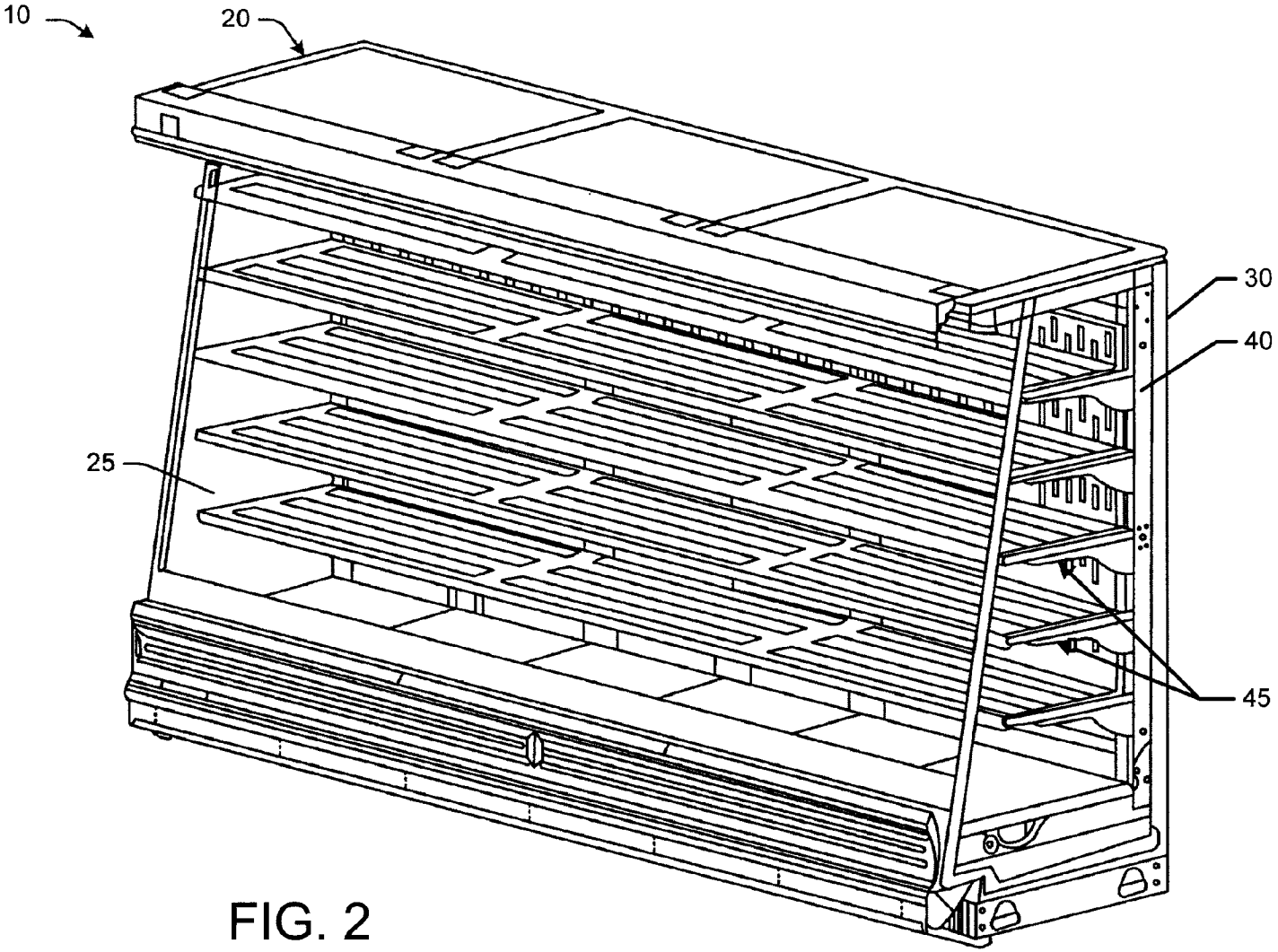
FIG. 2 is a perspective view of a portion of a known refrigerated display case in the form of a multi-deck cooler.

Referring now to the drawings, in which like numerals refer to like elements throughout the several views, FIG. 1 and FIG. 2 show examples of a refrigerated display case 10. Specifically, FIG. 1 shows the refrigerated display case 10 in the form of a reach-in cooler 15 while FIG. 2 shows the refrigerated display case 10 in the form of a multi-deck cooler 20. In both examples, the refrigerated display case 10 may be substantially modular and may extend to any suitable length or size. The refrigerated display case 10 may define a refrigerated display space 25 therein. Any type or number of refrigerated or frozen products may be positioned within the refrigerated display space 25. The refrigerated display case 10 and the components thereof may have any suitable size, shape, or configuration. Non-refrigerated or heated merchandising display cases also may be used herein.

Generally described, the refrigerated display case 10 may include an aft wall 30. The aft wall 30 may include a number of insulated panels and may define an air plenum therethrough for a flow of refrigerated air into the refrigerated space 25. In the case of the reach-in cooler 15, the reach-in cooler 15 also may include a number of door panels 35 enclosing the refrigerated display space 25. The door panels 35 may have any suitable size, shape, or configuration. The door panels 35 may be transparent in whole or in part. In the case of the multi-deck cooler 20, the refrigerated display space 25 of the multi-deck cooler 20 may be largely open to the consumer although an air curtain and the like may be used. A number of shelf standards 40 may be positioned about the aft wall 30. The shelf standards 40 may be made out of any type of substantially rigid metallic materials or other type of load bearing material. The shelf standards 40 may support a number of shelf assemblies 45 thereon. The shelf assemblies 45 may have any suitable size, shape, or configuration.

Figure 3:
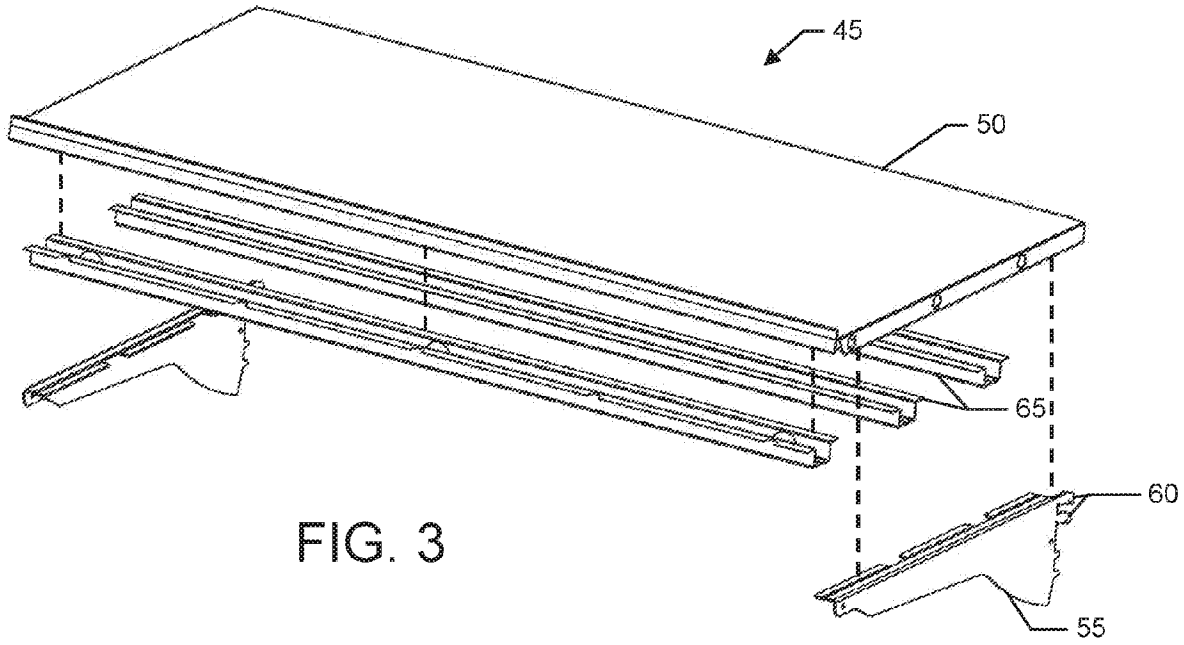
FIG. 3 is an exploded view of a known shelf assembly with spot welded connections.

FIG. 3 shows an example of a known shelf assembly 45. The shelf assembly 45 may include a shelf 50. The shelf 50 generally may be made out of a substantially rigid metallic material and the like. The shelf 50 generally may be rectangular but may have any suitable size, shape, or configuration. The shelf 50 may sit on a pair of shelf brackets 55. The shelf brackets 55 may have a number of anchor tabs 60 at one end thereof. The anchor tabs 60 may secure the shelf brackets 55 within apertures of the shelf standard 40. A number of support rails 65 may be attached to the bottom of the shelf 50 and generally may extend the length of the shelf 50 between the shelf brackets 55. The support rails 65 may be hat-like in shape and may be welded to the bottom of the shelf 50. The support rails 65 may be made out of a substantially rigid metallic material and the like. The metallic material may be required to accommodate welding. The shelf assembly 45 described herein is for purpose of example only. Many other types of shelf assemblies may be used.

Figure 4A:
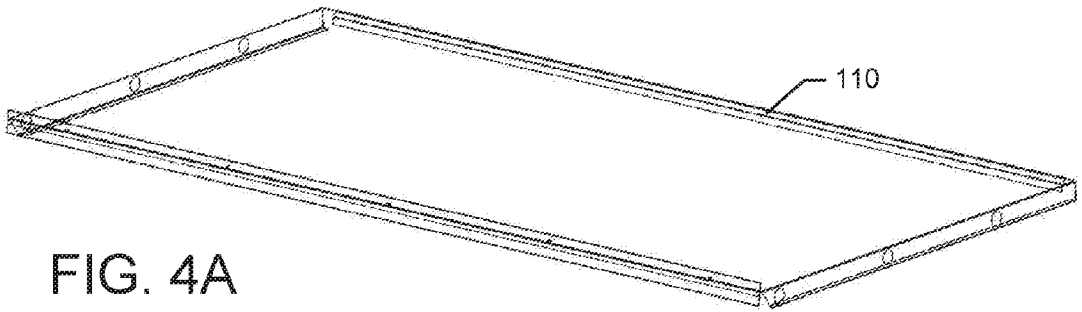
FIG. 4A is perspective view of a shelf of a snap fit shelf assembly as may be described herein.
Figure 4B:
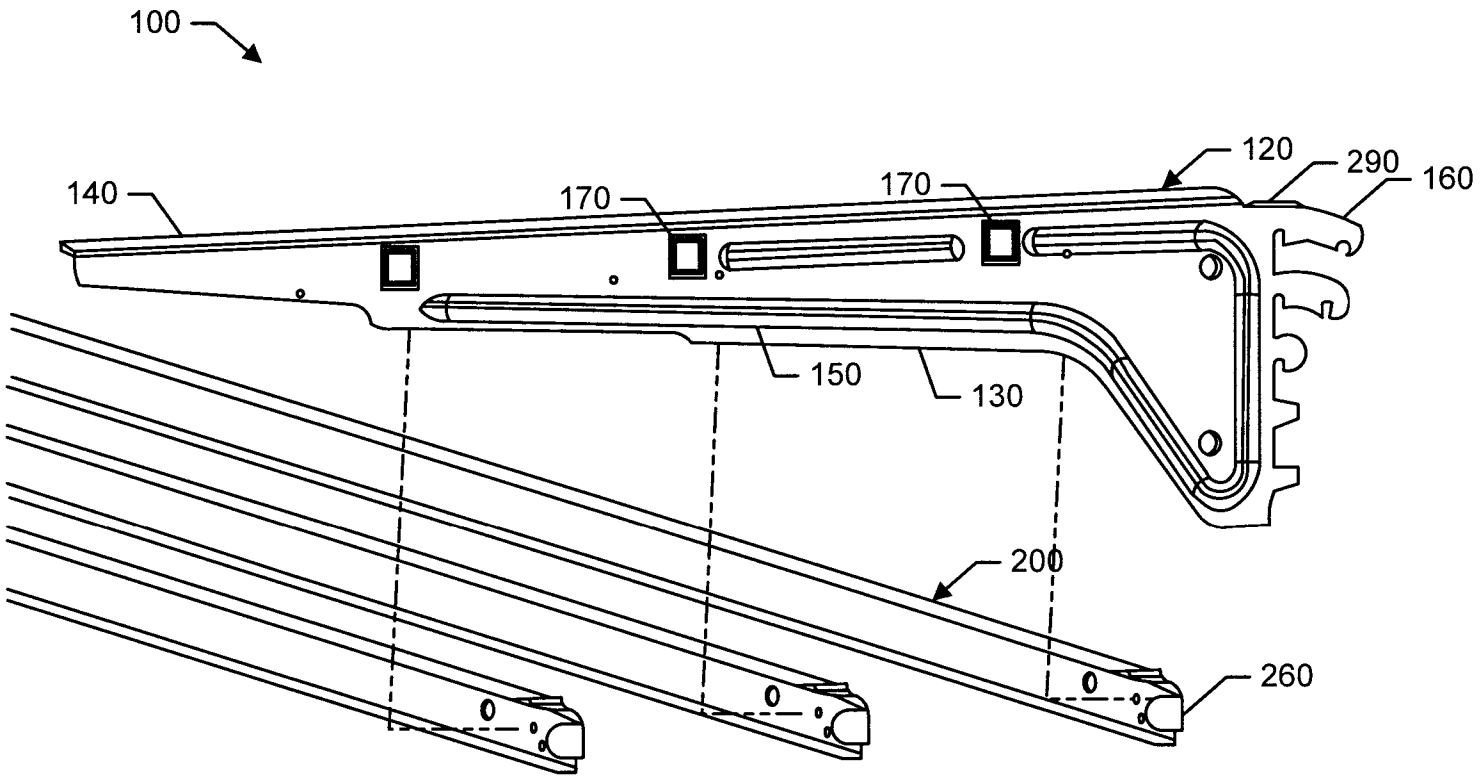
FIG. 4B is an exploded view of a shelf bracket and a number of support rails of the snap fit shelf assembly as may be described herein.

FIGS. 4A and 4B show an example of a shelf assembly 100 as may be described herein. The shelf assembly 100 may include a shelf 110. The shelf 110 may be made out of any type of substantially rigid metallic material. Alternatively, the shelf 110 also may be made out of other types of substantially rigid materials including thermoplastics, composites, and the like. These other materials may be used because welding the components of the shelf assembly 100 may not be required. The shelf 110 may have any suitable size, shape, or configuration.

Figure 5:
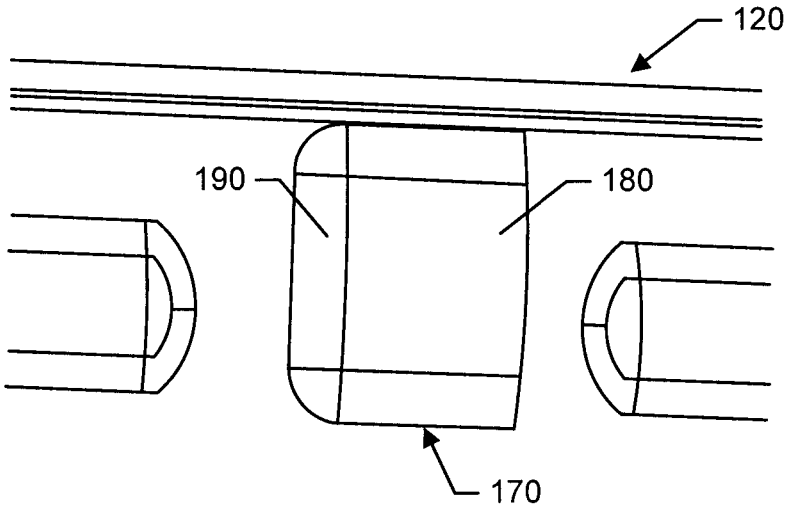
FIG. 5 is a perspective view of a portion of a shelf bracket that may be used with the snap fit shelf assembly of FIG. 4B.

As is shown in FIGS. 4B and 5, the shelf assembly 100 may include a pair of shelf brackets 120. Generally described, the shelf brackets 120 may include a skirt portion 130 with a lip portion 140 extending therefrom at a substantially right angle. The skirt portion 130 and the lip portion 140 may extend along at least a portion of the length of the shelf bracket 120. The skirt portion 130 and the lip portion 140 may have any suitable size, shape, or configuration. The shelf 110 may rest upon the lip portion 140 of the shelf bracket 120. The skirt portion 130 may have a number of support ribs 150 formed therein. Any number of support ribs 150 may be used in any suitable size, shape, or configuration. A number of anchoring tabs 160 may extend from the skirt portion 130. The anchoring tabs 160 may be sized and shaped so as to be positioned within the apertures of the shelf standard 40. Any number of the anchoring tabs 160 may be used herein in any suitable size, shape, or configuration. The shelf brackets 120 may be made out of any type of substantially rigid metallic material. Alternatively, other types of substantially rigid materials such as thermoplastics, composites, and the like may be used.

The shelf brackets 120 also may include a number of shelf bracket pockets 170 positioned along the skirt portion 130 or elsewhere. Although three shelf bracket pockets 170 are shown, any number may be used herein. The shelf bracket pockets 170 may include an inwardly dented portion 180. The inwardly dented portion 180 may form a slot 190 therethrough. Any number of the shelf bracket pockets 170 may be used herein in any suitable size, shape, or configuration.

Figure 6:
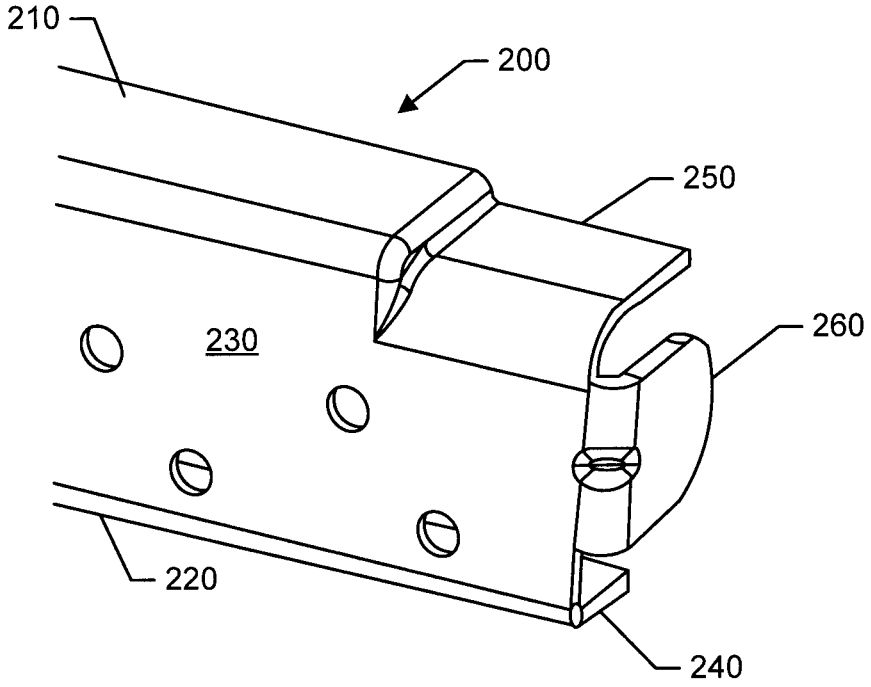
FIG. 6 is a perspective view of a portion of a support rail that may be used with the snap fit shelf assembly of FIG. 4B.

As is shown in FIGS. 4B and 6, the shelf assembly 100 also may include a number of support rails 200. The support rails 200 may extend between and connect to the shelf brackets 120. The support rails 200 may include a first wall 210, a second wall 220, and a connecting wall 230 forming a substantial U-like shape. The first wall 210, the second wall 220, and the connecting wall 230 may extend between a pair of rail ends 240. The first wall 210, the second wall 220, and the connecting wall 230 may have any suitable size, shape, or configuration. The first wall 210 may have an indented or a channeled portion 250 at both of the ends 240. The channeled portion 250 may have any suitable size, shape, or configuration. The connecting wall 230 may have a locking tab 260 extending therefrom. The locking tab 260 may extend between the walls 210, 220 or positioned otherwise. The locking tab 260 may be sized and shaped so as to fit within the slot 190 of the shelf brackets 120. The locking tab 260 and the slot 190 may have any type of complimentary shapes. The support rails 200 may be made out of any type of substantially rigid metallic material. Alternatively, any other type of substantially rigid material may be used herein including thermoplastics, composites, and the like. Other components and other configurations may be used herein.

Figure 7:
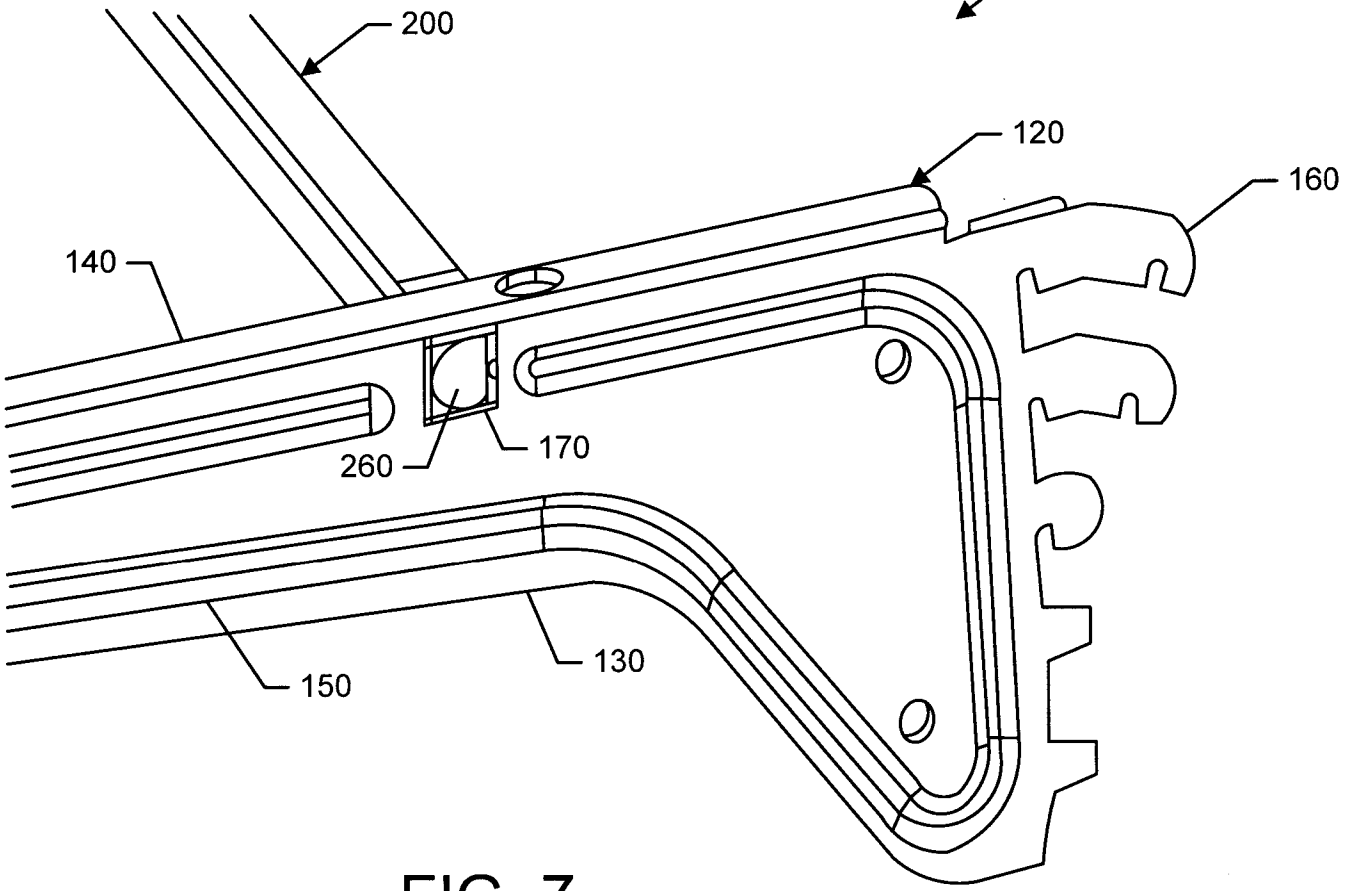
FIG. 7 is a perspective view of a portion of the snap fit shelf assembly of FIG. 4B.
Figure 8:
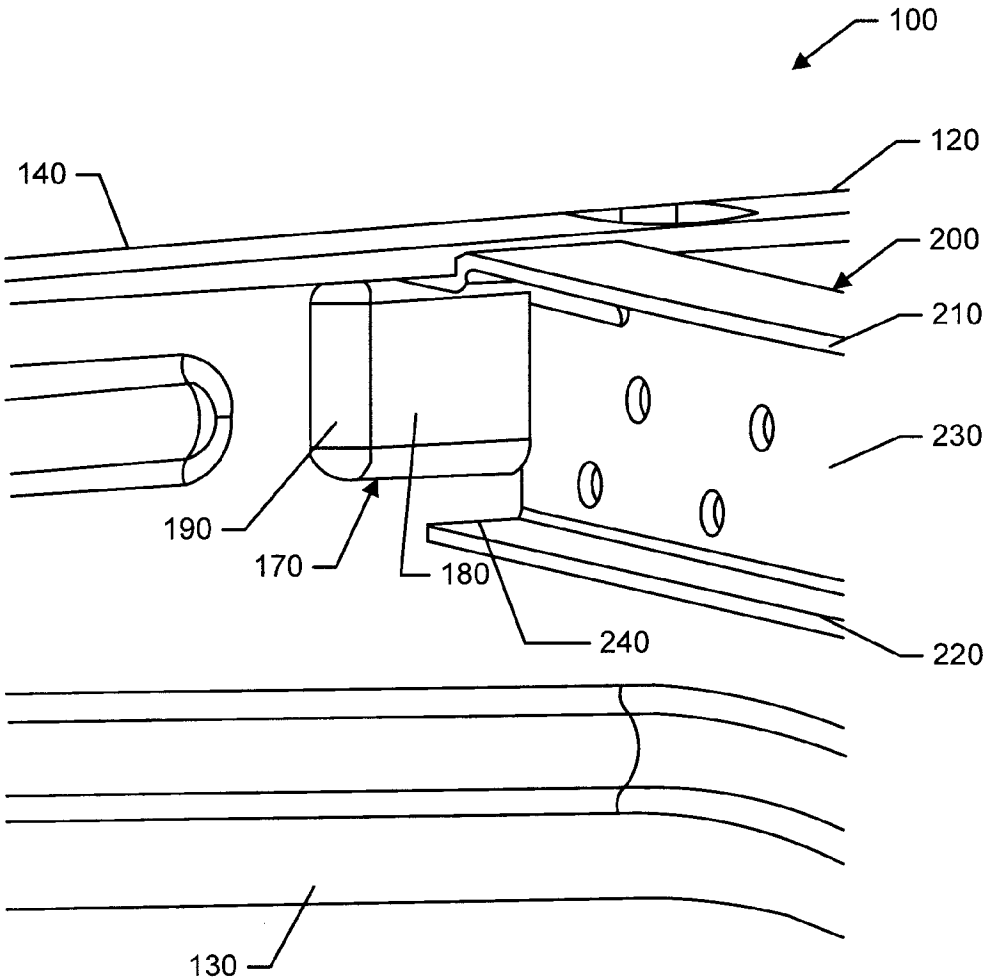
FIG. 8 is a further perspective view of a portion of the snap fit shelf assembly of FIG. 4B.

FIGS. 7 and 8 show one of the support rails 200 attached to one of the shelf brackets 120. Specifically, the channeled portion 250 at the end 240 of the support rail 200 aligns underneath the lip 140 of the shelf bracket 120. The locking tab 260 then may be inserted within the slot 190 of the shelf bracket pockets 170 so as to be secured therein. Specifically, the locking tab 260 may be positioned with the slot 190 in largely a snap fit like manner. The shelf 110 then may be positioned on top of the shelf brackets 120 and the support rails 200. Other orders of assembly may be used herein. The shelf assembly 100 may be disassembled in a substantially reversed manner. The shelf assembly 100 thus may be quickly and easily assembled on-site or elsewhere without the need for welding or other types of permanent assembly means.

Figure 9:
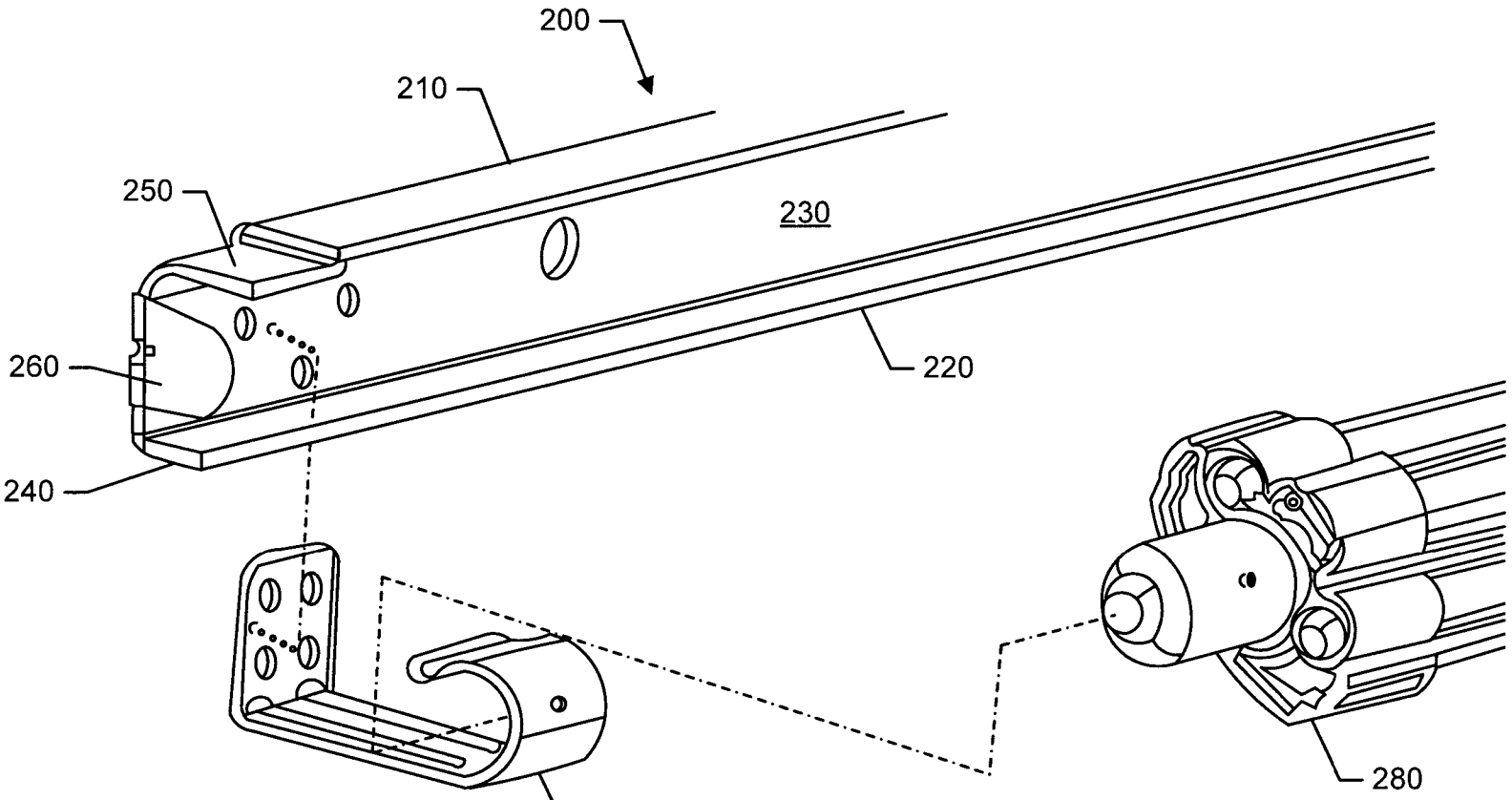
FIG. 9 is a perspective view of a portion of the snap fit shelf assembly of FIG. 4B with a lighting fixture.

FIG. 9 shows a further embodiment of the shelf assembly 100. In this example, the one or more of the support rails 200 may have an LED bracket 270 attached thereto. The LED bracket 270 may have any suitable size, shape, or configuration. The LED bracket 270 may be attached via screws, bolts, or other types of fastening means. Alternatively, the LED bracket 270 also could be a snap fit into the support rail 200. A conventional LED fixture 280 may be inserted within the LED bracket 270. Other types of lighting devices and the like may be used herein. Other types of auxiliary accessories and components also may be attached hereto. Other types of functional and other components also may be used herein.

Figure 10:
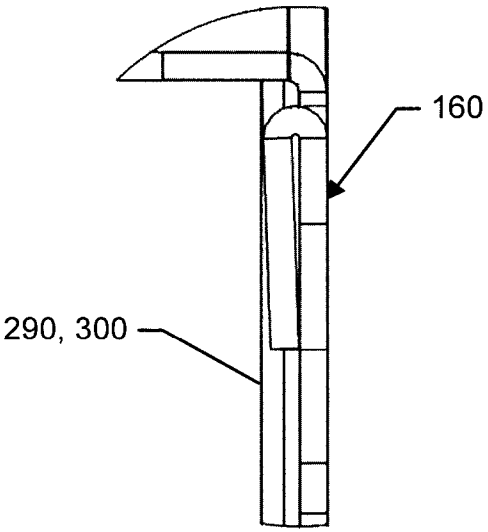
FIG. 10 is a partial front plan view of a shelf bracket that may be used with the snap fit shelf assembly of FIG. 4B.

As described above, the shelf brackets 120 may be strengthened by the use of the ribs 150 formed therein. As is shown in FIGS. 4B, 7, and 10, one or more of the anchoring tabs 160 also may include a teardrop hem 290 thereon for additional strength. The teardrop hem 290 may wrap around at least a portion of the anchoring tabs 160 in whole or in-part. The teardrop hem 290 may be in the form of a teardrop configuration 300 for increased strength. The teardrop hem 290 and the teardrop configuration 300 may have any suitable size, shape, or configuration.

The shelf assembly 100 described herein thus provides for ease of installation and assembly without the use of time consuming welding and the like. The shelf assembly 100 provides for ease of installation while providing improved shelf loading with reduced deflection. Moreover, given the lack of welding, the shelf assembly 100 and the components thereof may be made out of materials other than metals. For example, thermoplastics, composites, and the like may be used herein so as to provide reduced costs and reduce overall weight.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A weldless shelf assembly for a refrigerated merchandising display case, the merchandising display case having a plurality of walls forming a refrigerated display space, the plurality of walls comprising an aft wall having a plurality of shelf standards, the merchandising display case having a longitudinal dimension extending horizontally away from the aft wall and a lateral dimension extending horizontally and orthogonal to the longitudinal dimension, and a vertical dimension orthogonal to both the longitudinal and lateral dimensions, the weldless shelf assembly comprising:

a shelf formed from a rigid material and having a rectangular shape;

a plurality of shelf brackets configured to be releasably coupled to the plurality of shelf standards and which support the shelf when in an assembled position, each shelf bracket extending longitudinally when in the assembled position;

a plurality of support rails weldlessly and releasably coupled to the plurality of shelf brackets and extending laterally when in the assembled position;

wherein each shelf bracket of the plurality of shelf brackets comprises:

a shelf bracket body configured to extend longitudinally away from the aft wall when in the assembled position, the shelf bracket body having a lip portion formed on a most vertical portion of the shelf bracket when in the assembled position, the lip portion receiving a portion of the shelf, a plurality of anchoring tabs configured to releasably couple to the plurality of shelf standards when in the assembled position, a skirt portion extending vertically downward from the lip portion and extending longitudinally along the shelf bracket body between an aft end and a proximal end opposite the aft end that extends most longitudinally from the aft wall, the skirt portion coupled to the plurality of anchor tabs proximate the aft end, the skirt portion and the lip portion forming a substantially right angle therebetween, and a plurality of shelf bracket pockets formed on the skirt portion and extending longitudinally and vertically in the assembled position, each shelf bracket pocket comprising an inwardly dented portion and a slot therethrough, the slot comprising an opening that opens in the longitudinal direction when in the assembled position and has a vertical dimension, wherein each support rail comprises:

a support rail body extending laterally in the assembled position between a first end and a second end, the support rail body comprising a substantially "U" shape having a top wall that is coupled to a connecting wall that is coupled to a bottom wall, an indented portion formed as a downward step on each of the first end and second end of the support rail body, the downward step extending downward approximately a thickness of the lip portion of the shelf bracket body and extending horizontally approximately a lateral width of the lip portion, and a locking tab formed on each of the first end and second end of the support rail body, the locking tab extending from the connecting wall horizontally and in the longitudinal direction when in the assembled position, the locking tab configured to mate complimentarily with the opening of the slot of the shelf bracket pockets to form a secure, weldless coupling; and wherein in the assembled position each locking tab mates with a corresponding shelf bracket pocket of the plurality of shelf brackets such that the locking tab extends through the slot and horizontally and longitudinally into the shelf bracket pocket.

2. The weldless shelf assembly for refrigerated merchandising display cases of claim 1, wherein each of the plurality of shelf brackets further comprises a plurality of support rib portions formed on the skirt portion.

3. A refrigerated merchandising display case comprising:

a plurality of walls forming a refrigerated display space and having an aft wall;

a plurality of shelf standards coupled to the aft wall;

wherein the merchandising display case has a longitudinal dimension extending horizontally away from the aft wall and a lateral dimension extending horizontally and orthogonal to the longitudinal dimension, and a vertical dimension orthogonal to both the longitudinal and lateral dimensions;

a weldless shelf assembly, the weldless shelf assembly comprising:

a shelf formed from a rigid material;

a plurality of shelf brackets releasably coupled to the plurality of shelf standards and which support the shelf when in an assembled position, each shelf bracket extending longitudinally when in the assembled position;

a plurality of support rails weldlessly and releasably coupled to the plurality of shelf brackets and extending laterally when in the assembled position;

wherein each shelf bracket of the plurality of shelf brackets comprises:

a shelf bracket body extending longitudinally away from the aft wall when in the assembled position, the shelf bracket body having a lip portion formed on a most vertical portion of the shelf bracket when in the assembled position, the lip portion receiving a portion of the shelf, a plurality of anchoring tabs releasably coupled to the plurality of shelf standards when in the assembled position, a skirt portion extending vertically downward from the lip portion and extending longitudinally along the shelf bracket body between an aft end and a proximal end opposite the aft end that extends most longitudinally from the aft wall, the skirt portion coupled to the plurality of anchor tabs proximate the aft end, the skirt portion and the lip portion forming a substantially right angle therebetween, and a plurality of shelf bracket pockets formed on the skirt portion and extending longitudinally and vertically in the assembled position, each shelf bracket pocket comprising an inwardly dented portion and a slot therethrough, the slot comprising an opening that opens in the longitudinal direction when in the assembled position and has a vertical dimension, wherein each support rail comprises:

a support rail body extending laterally in the assembled position between a first end and a second end, the support rail body comprising a substantially "U" shape having a top wall that is coupled to a connecting wall that is coupled to a bottom wall, an indented portion formed as a downward step on each of the first end and second end of the support rail body, the downward step extending downward approximately a thickness of the lip portion of the shelf bracket body and extending horizontally approximately a lateral width of the lip portion, and a locking tab formed on each of the first end and second end of the support rail body, the locking tab extending from the connecting wall horizontally and in the longitudinal direction when in the assembled position, the locking tab configured to mate complimentarily with the opening of the slot of the shelf bracket pockets to form a secure, weldless coupling; and wherein in the assembled position each locking tab mates with a corresponding shelf bracket pocket of the plurality of shelf brackets such that the locking tab extends through the slot and horizontally and longitudinally into the shelf bracket pocket.

* * * * *